US007124897B2

(12) United States Patent
Bustos

(10) Patent No.: US 7,124,897 B2
(45) Date of Patent: Oct. 24, 2006

(54) PRODUCT DISPLAY AND FRONTING ASSEMBLY

(75) Inventor: Rafael T. Bustos, Atlanta, GA (US)

(73) Assignee: L&P Property Management Company, South Gate, CA (US)

( * ) Notice: Subject to any disclaimer, the term of this patent is extended or adjusted under 35 U.S.C. 154(b) by 290 days.

(21) Appl. No.: 10/254,449

(22) Filed: Sep. 25, 2002

(65) Prior Publication Data

US 2003/0061973 A1 Apr. 3, 2003

Related U.S. Application Data

(60) Provisional application No. 60/324,594, filed on Sep. 25, 2001.

(51) Int. Cl.
*A47F 1/04* (2006.01)

(52) U.S. Cl. ..... 211/59.3; 108/60; 108/5.11

(58) Field of Classification Search ..... 108/51.11, 108/55.3, 55.1, 53.5, 60, 61; 211/59.3, 59.1, 211/88.02, 90.01, 94.01, 162, 134, 153, 59.2, 211/126.15, 126.16
See application file for complete search history.

(56) References Cited

U.S. PATENT DOCUMENTS

| | | | | | |
|---|---|---|---|---|---|
| 1,702,987 | A | | 2/1929 | Wilson | |
| 1,708,407 | A | | 4/1929 | Arnold | |
| 2,079,754 | A | | 5/1937 | Waxgiser | |
| 2,098,844 | A | | 11/1937 | Waxgiser | |
| 2,652,154 | A | | 9/1953 | Stevens | |
| 2,980,259 | A | | 4/1961 | Fowlds | |
| 3,028,014 | A | | 4/1962 | Southwick | |
| 3,083,067 | A | * | 3/1963 | Vos et al. | 211/59.3 |
| 3,110,402 | A | * | 11/1963 | Mogulescu | 211/59.3 |
| 4,042,096 | A | | 8/1977 | Smith | |
| 4,069,941 | A | * | 1/1978 | Popplewell et al. | 211/126.3 |
| 4,300,693 | A | * | 11/1981 | Spamer | 211/59.3 |
| 4,724,968 | A | * | 2/1988 | Wombacher | 211/59.3 |
| 4,762,236 | A | | 8/1988 | Jackle, III et al. | |
| 4,785,945 | A | * | 11/1988 | Rowse et al. | 211/59.2 |
| 4,836,390 | A | | 6/1989 | Polvere | |
| 4,907,707 | A | | 3/1990 | Crum | |
| 5,012,936 | A | | 5/1991 | Crum | |
| 5,123,546 | A | | 6/1992 | Crum | |
| 5,160,051 | A | | 11/1992 | Bustos | |
| 5,197,610 | A | | 3/1993 | Bustos | |
| 5,215,421 | A | | 6/1993 | Smith | |
| 5,228,581 | A | * | 7/1993 | Palladino et al. | 211/153 |
| 5,411,146 | A | | 5/1995 | Jarecki | |
| 5,413,229 | A | | 5/1995 | Zuberbuhler et al. | |
| 5,542,552 | A | | 8/1996 | Yablans et al. | |
| 5,638,963 | A | | 6/1997 | Finnelly et al. | |

(Continued)

*Primary Examiner*—Jose V. Chen
(74) *Attorney, Agent, or Firm*—Michael Best & Friedrich LLP

(57) ABSTRACT

A product fronting assembly and method for fronting product is provided. In some embodiments, the assembly includes a base having a bottom, a front, a rear, and opposite sides. The assembly can also include a frame slidable within the base and having a front at least partially defining a handle and opposed sides coupled to the front of the frame. The opposed sides can be spaced a distance apart and between which product upon the base is received, and can be positioned to rest and slide upon the bottom and/or sides of the base. In some embodiments, the frame also includes a rear coupled to the opposed sides and movable by movement of the front of the frame to front product in the assembly.

21 Claims, 11 Drawing Sheets

U.S. PATENT DOCUMENTS

| | | | |
|---|---|---|---|
| 5,673,801 | A | 10/1997 | Markson |
| 5,720,230 | A | 2/1998 | Mansfield |
| 5,730,320 | A | 3/1998 | David |
| 5,738,019 | A | 4/1998 | Parker |
| 5,839,588 | A | 11/1998 | Hawkinson |
| 5,855,283 | A | 1/1999 | Johnson |
| 6,142,316 | A | 11/2000 | Harbour et al. |
| 6,155,438 | A | 12/2000 | Close |
| 6,164,462 | A | 12/2000 | Mumford |
| 6,227,386 | B1 | 5/2001 | Close |
| 6,375,015 | B1 | 4/2002 | Wingate |

* cited by examiner

PRODUCT DISPLAY AND FRONTING ASSEMBLY

This application claims the benefit and priority of U.S. provisional patent application Ser. No. 60/324,594 filed Sep. 25, 2001.

FIELD OF THE INVENTION

The present invention relates to systems and methods for displaying and dispensing products in a self-service retail environment. More particularly, the present invention relates to product displaying and dispensing systems and methods employing an inventory front-aligning feature.

BACKGROUND OF THE INVENTION

Stores and other retail environments often display merchandise for sale on shelves and pallets. These conventional arrangements create a number of problems. For example, customers typically remove and purchase products from the most accessible location (e.g., from the front of shelves or pallets). This creates an absence of products on the front of the shelves or pallets, which can be unattractive to consumers due to the disorganized appearance of the shelves or pallets.

Store employees typically replace merchandise at the front of a shelf or pallet by manually sliding or picking up merchandise from the rear of the shelf or pallet, and moving the merchandise to the front of the shelf or pallet. The process of moving merchandise from a rearward position of a shelf or pallet to a more forward position on the shelf or pallet is known as "fronting" the merchandise. This can prove to be a difficult task when other shelving is located directly over the shelves or pallets making access to the merchandise at the rear of the shelves or pallets more difficult.

Injuries often occur when accessing merchandise located at the rear of conventional shelves and pallets. For example, head injuries can occur when individuals accidentally strike themselves against overhead shelves while fronting merchandise. As other examples, serious back and/or leg injuries can occur when bending over or stretching to pick up merchandise from the rear of the shelves or pallets.

As a result of the foregoing problems, employees often neglect to front merchandise. This can have several undesirable consequences. For example, if the front of the shelf or pallet remains unstocked, customers who wish to purchase the merchandise thereon may have to reach to the back of the shelf or pallet in order to reach the merchandise. Many such customers will either forego purchasing such merchandise due to its reduced accessibility or will injure themselves in an attempt to reach and retrieve the merchandise. Also, the failure to restock the front of such shelves or pallets presents an unsightly appearance to consumers and may give consumers the impression that a store is sold out of a particular item or is low in stock on a particular item.

As an alternative to foregoing fronting of merchandise from the rear to the front of the shelf or pallet, store employees may restock the front of the shelf or pallet using newer merchandise, merchandise that has just arrived at the store, or merchandise that is stored elsewhere in the store, rather than using the stock already stored or located at the rear of the display shelf or pallet. While this approach may temporarily solve the problem relating to the lack of readily-available merchandise, it often results in newer stock being sold prior to older stock. This can create stocking problems and, depending on the type of merchandise in question, result in spoiled or expired merchandise that cannot be sold.

Although the problems and limitations described above are with respect to merchandise on shelves or racks, similar problems and limitations exist in non-retail environments, such as warehouses, mail and shipping facilities, and in other locations where items are stored and/or displayed on a pallet, shelf, rack, or other similar structure.

SUMMARY OF THE INVENTION

The present invention provides a product fronting assembly for fronting merchandise, packages, parts, equipment, and other products. Although the present invention is particularly well-suited for fronting items in retail environments, the term "product"(as used herein and in the appended claims) refers to all such items in any environment, including those described above.

The assembly according to some embodiments of the present invention includes a base having a bottom, a front, a rear, and opposite sides. The assembly can also include a frame slidable within the base and having a front at least partially defining a handle and opposed sides coupled to the front of the frame. The opposed sides can be spaced a distance apart and between which product upon the base is received, and can be positioned to rest and slide upon the bottom and/or sides of the base. In some embodiments, the frame also includes a rear coupled to the opposed sides and movable by movement of the front of the frame.

In some embodiments, the present invention can also provide an assembly including a divider having a base wall and opposing side walls extending from the base wall and a frame slidably positioned within the divider and at least partially extending around product supported by the divider, wherein the frame includes a handle, a product engaging portion operable to engage product supported by the divider, and opposing side members spaced a distance from one another and coupled to the handle and the product engaging portion. The product engaging portion can be movable by movement of the handle.

Also, in some embodiments of the present invention, a method is provided in which a product fronting assembly is used to front product. The product fronting assembly can include a base having a bottom, front, rear, and opposite sides spaced a distance from one another, and a frame having a front at least partially defining a handle, sides spaced a distance from one another, coupled to the front of the frame and slidable within the base, and a rear coupled to the sides of the frame. Product to be fronted can be positioned between the opposed sides of the frame. The method in which this product fronting assembly is employed can include moving the front of the frame to cause the rear of the frame to move, engaging the rear of the frame with product positioned between the opposed sides of the frame, moving the product toward a front of the product fronting assembly while the front of the frame is moving, and releasing the front of the frame when the product is desirably positioned toward the front of the product fronting assembly.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION OF THE PREFERRED EMBODIMENTS

Figure 1:
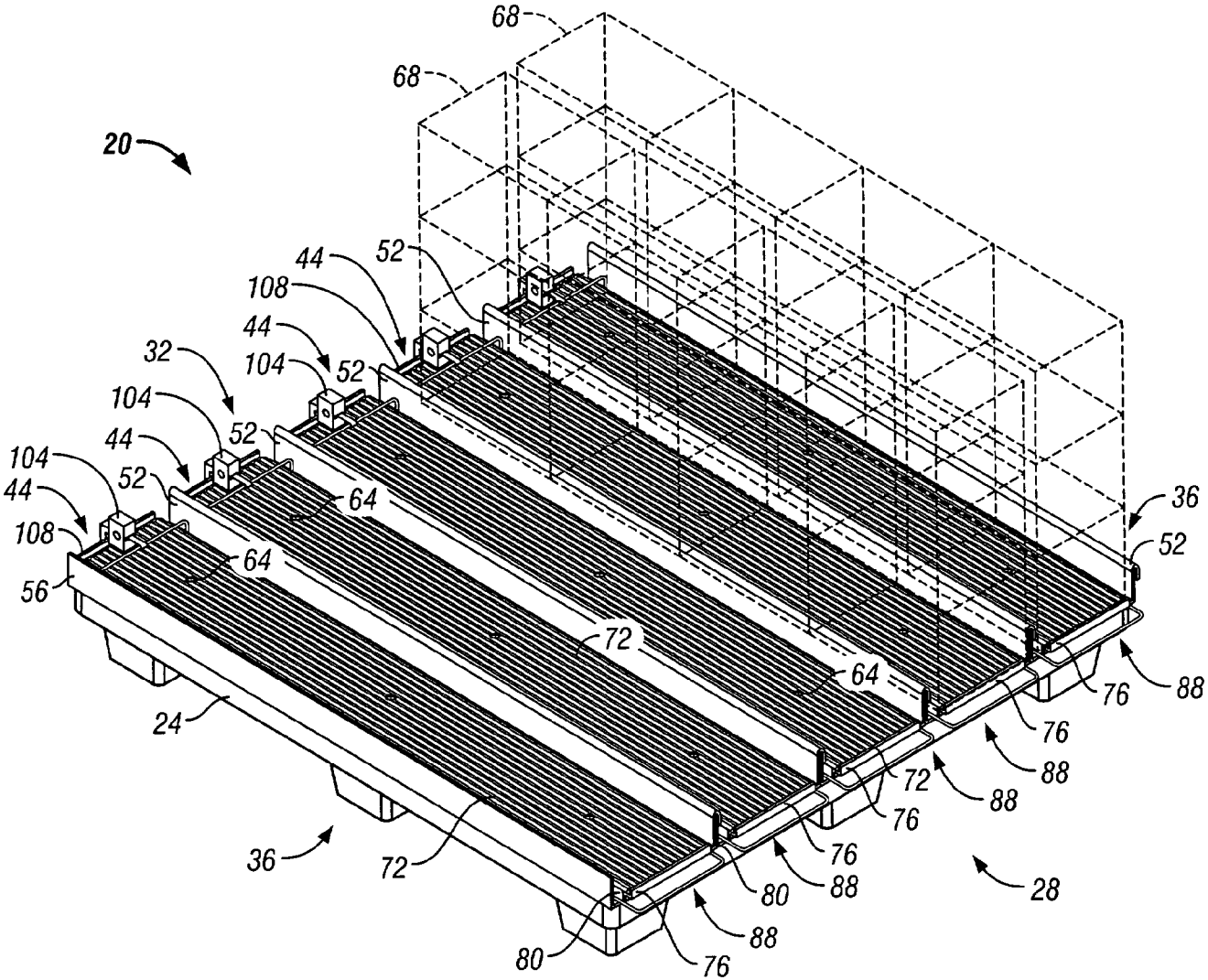
FIG. 1 is a front perspective view of a product fronting assembly according to an embodiment of the present invention, shown with products stored thereon in phantom.
Figure 2:
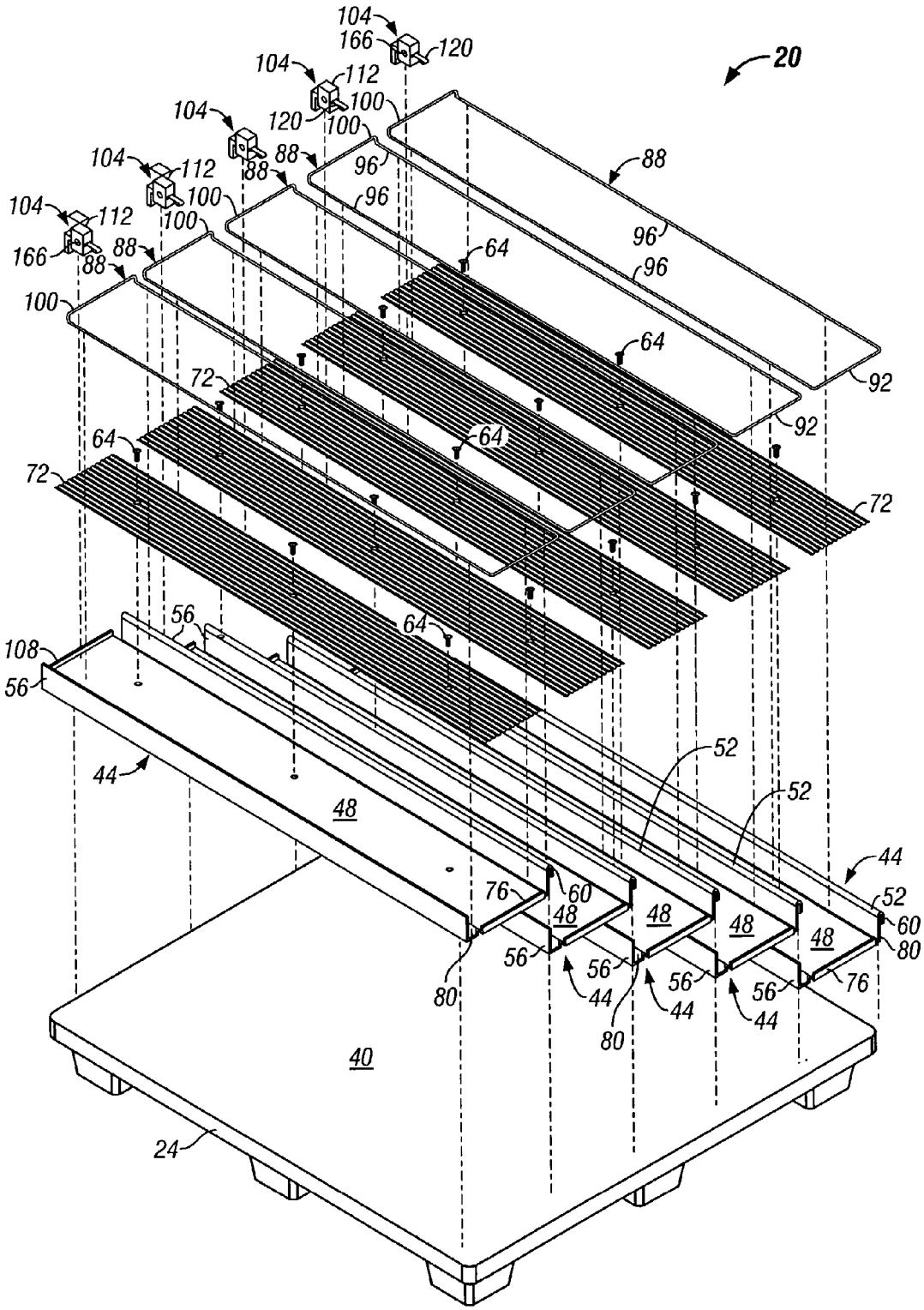
FIG. 2 is an exploded perspective view of the product fronting assembly shown in FIG. 1.
Figure 3:
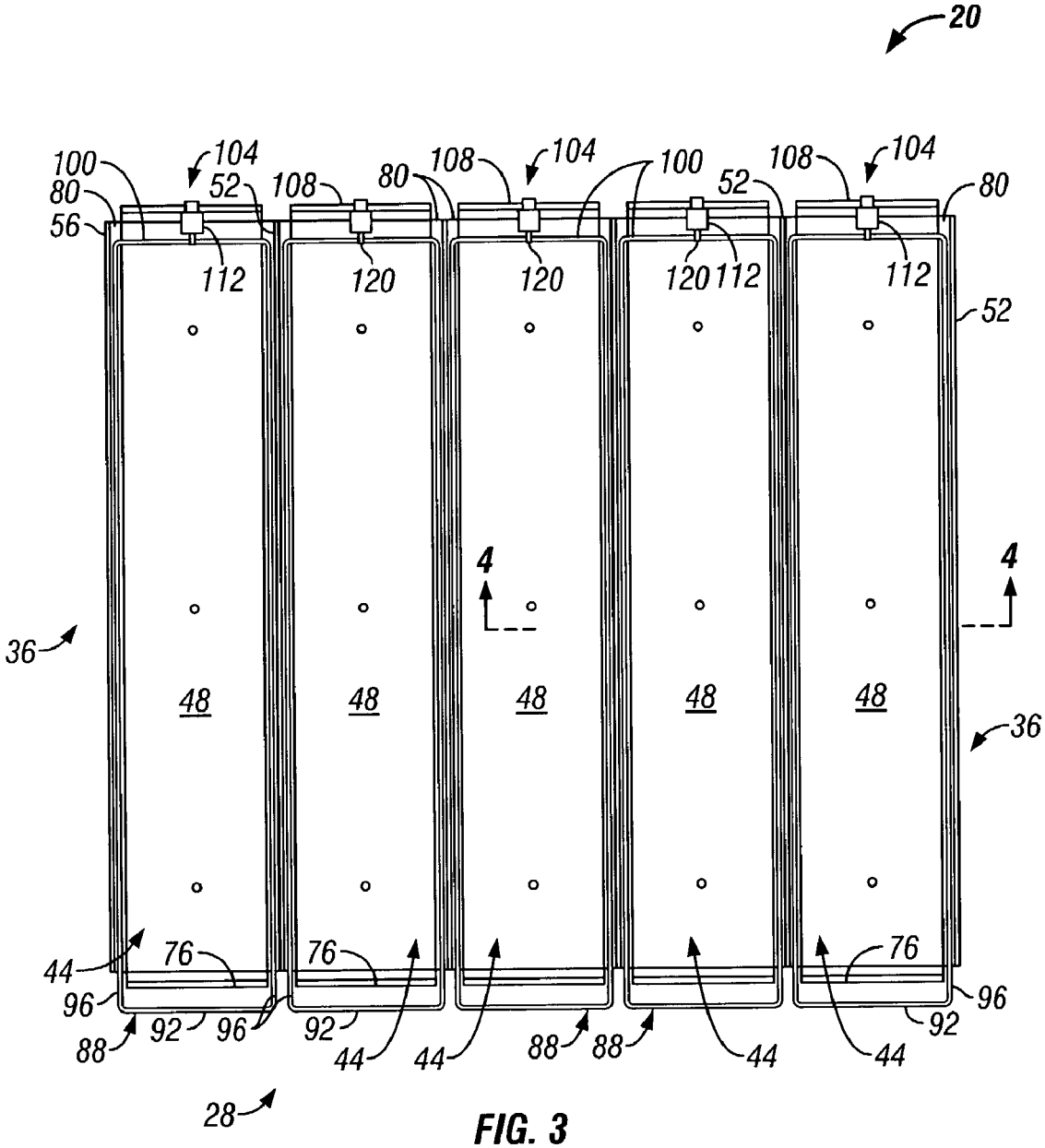
FIG. 3 is a top view of the product fronting assembly shown in FIGS. 1 and 2, shown with slides removed.

FIGS. 1–6 show a product display and fronting assembly 20 according to an exemplary embodiment of the present invention. For example, the assembly 20 includes a pallet 24 having a front 28, a rear 32, sides 36, and a top surface 40 (shown in FIG. 2). Although a pallet-based assembly 20 is shown, the present invention can be employed with any other product storage or display device or assembly used to store and/or display products (e.g., shelving, racks, and the like). Accordingly, the pallet 24 illustrated in FIGS. 1, 2, and 4 (and in any other embodiment of the present invention) is presented by way of example only. The assembly 20 further includes a plurality of dividers 44 supported on the top surface 40 of the pallet 24. In some embodiments of the present invention, the dividers 44 can be utilized without a pallet 24 or any other product storage and/or display device or assembly. In these embodiments, the dividers 44 can be self-supporting, functioning as shelves or racks themselves. Although multiple dividers 44 are illustrated in the figures, any number of dividers 44 (even one) can be employed in the present invention. Each divider includes a base wall 48, an engaging side wall 52 and an engaged side wall 56.

In the illustrated embodiment, each divider 44 is stamped from a single piece of sheet metal. However, as will be understood by those skilled in the art, the dividers 44 can be made in any suitable manner and of any suitable material. For example, the dividers 44 can be made of or include steel, aluminum, or any other type of metal, plastic, fiberglass, wood, and the like. Depending at least partially upon the type of material(s) used for the dividers 44, the dividers can be assembled, stamped, extruded, molded, cast, pressed, machined, formed, or can be manufactured in any other manner. It should also be noted that each divider 44 can be an integral element made of a single piece of material, or can instead be made of several individual components connected together. By way of example only, either or both walls 52 and 56 of each divider 44 can be made of individual components attached to the base wall 48 and/or to the pallet 24 by brazing, welding, screws, bolts, and other threaded fasteners, rivets, nails, pins, and other conventional fasteners, clamps, clips, inter-engaging tabs, fingers, or other elements, and the like. Although the illustrated dividers 44 each have opposed side walls 52, 56, the dividers in some alternative embodiments have only one wall, or can even have no walls (in which case the dividers 44 can be connected to one another in alternative manners to that described below with respect to the illustrated dividers 44).

With continued reference to the dividers 44 in the exemplary embodiment illustrated in FIGS. 1–6, the engaged side wall 56 of each divider 44 includes a single vertical member, while the engaging side wall 52 includes a vertical member and a curved flange 60 that runs at least part of the length of wall 52 to fit over and engage the side wall 56 of an adjacent divider 44. In this manner, adjacent dividers 44 can be joined and engaged without the need for separate connectors or tools. Once connected in this manner, the dividers 44 can be secured to the pallet 24 in any suitable manner, such as by securing bolts 64 or in any of the fastening manners described above with reference to assembly of multiple-part dividers 44.

It will be appreciated that other manners of connecting adjacent dividers 44 to one another are possible and fall within the spirit and scope of the present invention. For example, in some embodiments of the present invention, the dividers 44 can be joined together by one or more snap-fit connections. In some cases, one of the side walls 52, 56 can include at least one snap head or projection extending therefrom for connection to at least one receptacle in or on a side wall 56, 52 of an adjacent divider 44. In this manner, adjacent dividers 44 can be joined and engaged without the need for separate connectors or tools. Once secured in this manner, the dividers 44 can be secured to the pallet 24 in any suitable manner described above.

As another example, the dividers 44 can be joined together by inter-engaging elements such as fingers extending from either or both adjacent dividers 44. In some cases, each of the side walls 52, 56 can include at least one finger angling outward of the plane of the side walls 52, 56. The fingers on respective side walls 52, 56 can be opposed to one another such that the fingers inter-engage to connect the dividers 44. In this manner, adjacent dividers 44 can be connected without the need for separate connectors or tools.

As yet another example, the dividers 44 can be joined together by one or more fingers on one divider extending into engagement with one or more apertures in an adjacent divider. In this manner, adjacent dividers 44 can be connected without the need for separate connectors or tools.

The base wall 48 of each divider 44 is long enough to accommodate a row of product 68 (such as that shown in phantom in FIG. 1) stored and displayed thereon. As shown in FIG. 1, additional rows of product 68 can be stacked upon the base row of product 68. It should be noted that the assembly 20 illustrated in the figures is presented by way of example only, and that the dividers 44 and their base walls 48 can be dimensioned so as to accommodate any number of different types of products, including without limitation boxes of varying sizes, jars, bottles, packages, cans, bags, or any other items, whether these products are stored or displayed individually or in packaged, or bundled form. In particular, the dividers 44 can be longer or shorter, wider or narrower, and can have taller or shorter side wall(s) 52, 56 as appropriate for the type, size, number, and arrangement of products to be stored and displayed in the assembly 20. In addition, dividers 44 having varying dimensions can be employed in the same assembly 20. For example, the assembly 20 can have multiple dividers 44 having varying base wall widths to accommodate different products 68 of varying sizes in the assembly 20 as needed.

Each divider 44 in the illustrated embodiment of FIGS. 1–6 is provided with a slide to enable products 68 to move more easily across the base wall 48. In some embodiments of the present invention, the slide is an insert having a reduced friction surface (as compared to the base wall surface), or takes the form of a sliding or rolling device. In other embodiments of the present invention, the divider 44 does not require a slide because the base wall 48 of the divider 44 can be made of or include a low friction material. In the illustrated embodiment of FIGS. 1–6, the base wall 48 of each divider 44 is covered by a slide 72 that reduces the friction between the products 68 and the divider 44, thereby facilitating easier forward movement of the products 68 with respect to the pallet 24. In some embodiments of the present invention, the slide 72 is one or more elements constructed of any suitable material capable of reducing the friction between products 68 and the divider 44, thereby making it easier for the products 68 to move along the divider 44.

In the illustrated embodiment shown in FIGS. 1–4 and 6, each slide 72 is a corrugated sheet of plastic, Teflon, UHMW, or other synthetic low-friction material at least partially covering each base wall 48. In other embodiments, the slide 72 can take other shapes, such as flat, corrugated, dimpled, and other shapes, and can take other forms, such as, tracks or glides extending along the base wall 48, knobs or other projections extending up from the base wall, and the like. In addition, the slide can also be made of any other material, including without limitation metal, fiberglass, and the like, and can be shaped in any such manner.

With continued reference to the illustrated embodiment of FIGS. 1–6, a front stop 76 is associated with the front of each divider 44 in order to prevent products 68 from sliding off the front 28 of the pallet 24. The front stop 76 projects upwardly from the base wall 48 and in some embodiments can terminate above the slide 72 so that products 68 sliding on the slide 72 toward the front 28 of the pallet 24 will contact the front stop 76 and be stopped thereby. In the illustrated embodiment, the front stop 76 is generally rectangular in shape and is narrower than the side walls 52, 56. In other embodiments of the present invention, the front stop can take a number of different forms (e.g., one or more fingers, rods, bars, plates, and other elements extending in the pathway of products approaching the front of the divider 44) and can square, trapezoidal, and the like, and have any width spanning part or all of the distance between the side walls 52, 56.

Figure 4:
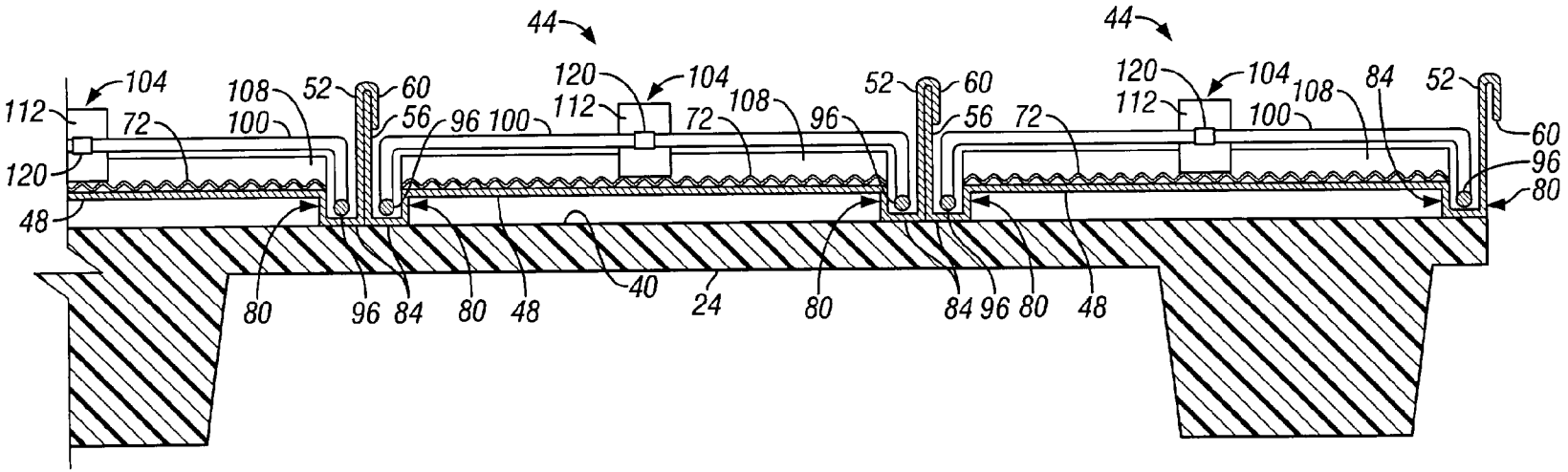
FIG. 4 is a cross-sectional view of the product fronting assembly shown in FIGS. 1–3, taken along line 4—4 in FIG. 3.
Figure 5:
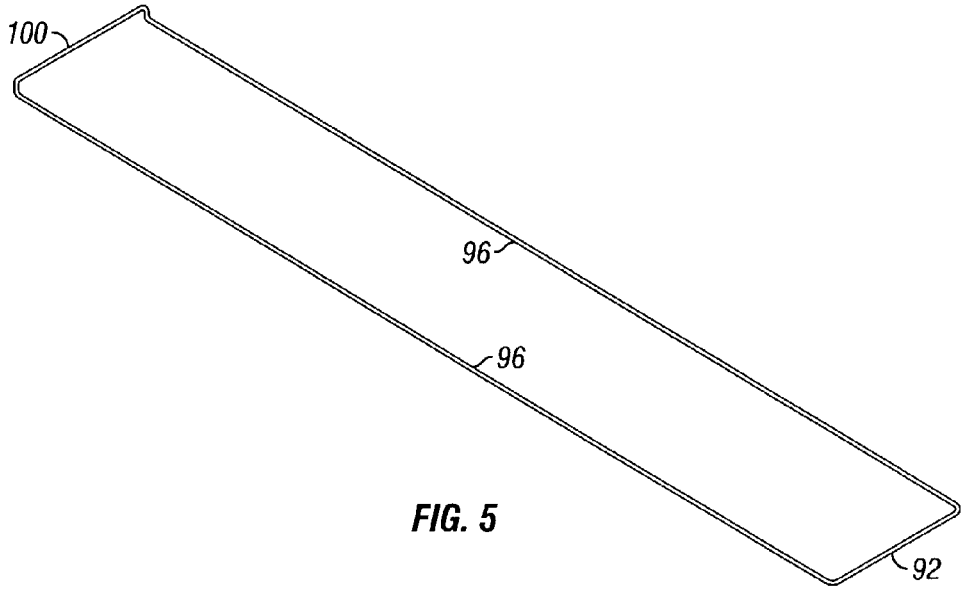
FIG. 5 is a front perspective view of a fronting device from the product fronting assembly shown in FIGS. 1–4.

Referring to FIGS. 1–6, and in particular to FIG. 4, the exemplary illustrated assembly 20 includes troughs 80 on each side of the base wall 48. The troughs 80 each have a bottom surface 84 that is positioned below the base wall 48. Although the bottom surface 84 of each trough 80 has an individual reference number and is described herein separately from the base wall 48, the bottom surface 84 and the base wall 48 can be collectively considered a bottom of the divider 44. In the illustrated embodiment, the bottom surface 84 is substantially horizontal. In some embodiments of the present invention, the bottom surface can take varying orientations and shapes, such as, slanted, corrugated, grooved, or channeled shapes, and the like. If desired, fasteners (not shown) can be inserted through the troughs 80 and into the pallet 24 to secure the dividers 44 to the pallet 24, thereby providing an alternate manner in which to secure the dividers 44 to the pallet 24. In still other embodiments, either or both troughs 80 can be connected to the pallet 24 in any suitable manner, including those described above with reference to the assembly of multiple-part dividers 44.

Each divider 44 in the illustrated embodiment of FIGS. 1–6 also includes a fronting mechanism 88 that can slide between a normal position in which the fronting mechanism 88 is not extended, and an extended position in which the fronting mechanism 88 is pulled forward by an operator. The fronting mechanism 88 is used to pull products 68 stored on the divider 44 forward (e.g., to fill empty spaces at the front 28 of the pallet 24, to make product more accessible, and the like). In some embodiments, the fronting mechanism 88 takes the form of a frame that extends at least partially around the product on the divider 44. This frame can be defined by any number of the same or different elements, including without limitation bars, rods, dowels, wire, angles, plates, and the like. In some cases, the fronting mechanism 88 extends completely around the product 68 on the divider 44.

Elements of the fronting mechanism 88 can be at varying elevations with respect to the products 68 and with respect to each other. These elements can be at any elevation, such as below the products 68, at the same level of the products 68, and above the products 68, or at any other elevation in which a portion of the fronting mechanism 88 is capable of contacting and pushing the products 68 along the divider 44.

The illustrated embodiment of the fronting mechanism 88 of FIGS. 1–6 is presented by way of example only and is not intended to be limiting. The fronting mechanism 88 can have different shapes and can be oriented in different manners from that shown in FIGS. 1–6 and discussed herein while still falling within the spirit and scope of the present invention. The illustrated fronting mechanism 88 includes a handle 92, side members 96, and a rear member 100. The side members 96 extend between and connect the handle 92 and the rear member 100. The handle 92 and side members 96 are oriented in substantially the same plane, while the rear member 100 extends vertically upward from the side members 96 and horizontally between the side members 96 at a distance above the plane of the handle 92 and side members 96. When the fronting mechanism 88 is positioned in the divider 44, the horizontally extending portion of the rear member 100 is positioned above the base wall 48 such that the rear member 100 can contact the rearmost product 68 when the handle 92 of the fronting mechanism 88 is pulled. The rear member 100 can take any shape or form in which a portion of the rear member extends to a higher elevation than the base wall 48 so that the rear member 100 can engage the rearmost product 68 when the handle 92 is pulled.

In alternative embodiments, the rear member 100 is defined entirely or in part by one or more plates, walls, rods, bars, beams, or fingers, and the like, oriented behind the rearmost product 68, each capable of pushing the rearmost product 68 when the fronting mechanism 88 is pulled. In this regard, the rear member 100 can be integral with respect to the other parts of the fronting mechanism 88 (e.g., the sides 96 and/or handle 92) or can be connected thereto in any manner, including those described above with reference to assembly of multiple-part dividers 44.

In the illustrated embodiment of FIGS. 1–6, the side members 96 and handle 92 are rigid rods or wire. However, the side members 96 can take any other suitable form capable of connecting the handle 92 to the rear member 100. Similarly, the handle 92 can take any other suitable form permitting a user to grasp and pull the fronting mechanism 88. By way of example only, the handle 92 and side members 96 can be or include bars, rods, beams, tubes, cable, rope, and the like. The side members 96 can be integral with the handle 92 and/or rear member 100, or can be separate elements connected to the handle 92 and/or rear member 100 in any suitable manner, such as by brazing, welding, threaded fasteners, or in any of the manners described above with reference to assembly of multiple-part dividers 44. In some embodiments such as the illustrated embodiment of FIGS. 1–6, the fronting mechanism 88 is a single loop of wire or rod material that can be painted or coated as desired. Alternatively, the fronting mechanism 88 can be made entirely or partially from any other material, including without limitation plastic, metal, wood, fiberglass, and the like.

Figure 6:
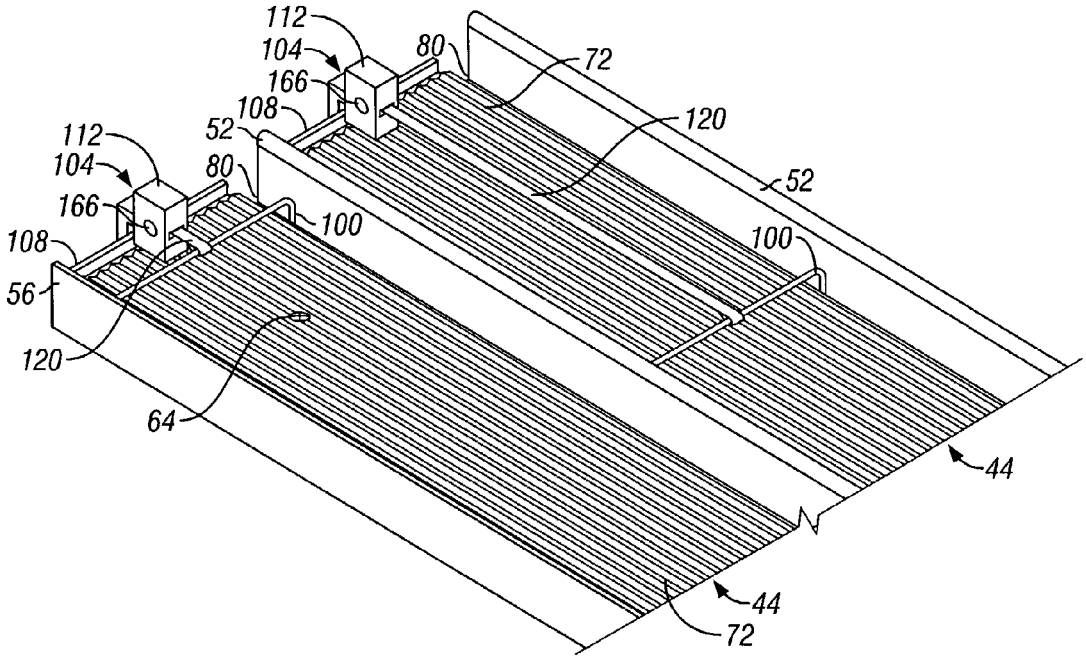
FIG. 6 is a detail view of a rear portion of the product fronting assembly shown in FIGS. 1–4, shown with one fronting device pulled forward.
Figure 7:
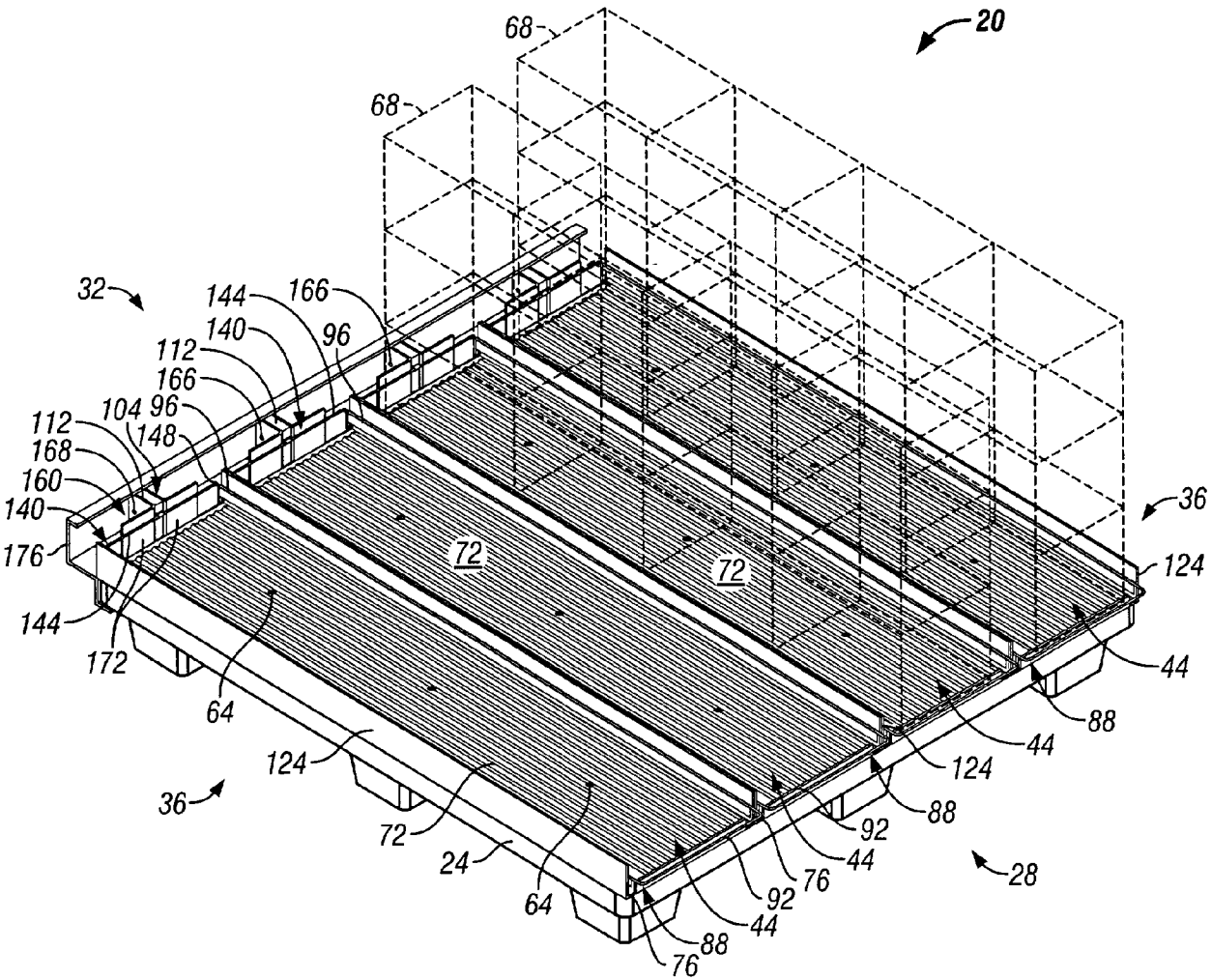
FIG. 7 is a front perspective view of a product fronting assembly according to another embodiment of the present invention, shown with products stored thereon in phantom.
Figure 8:
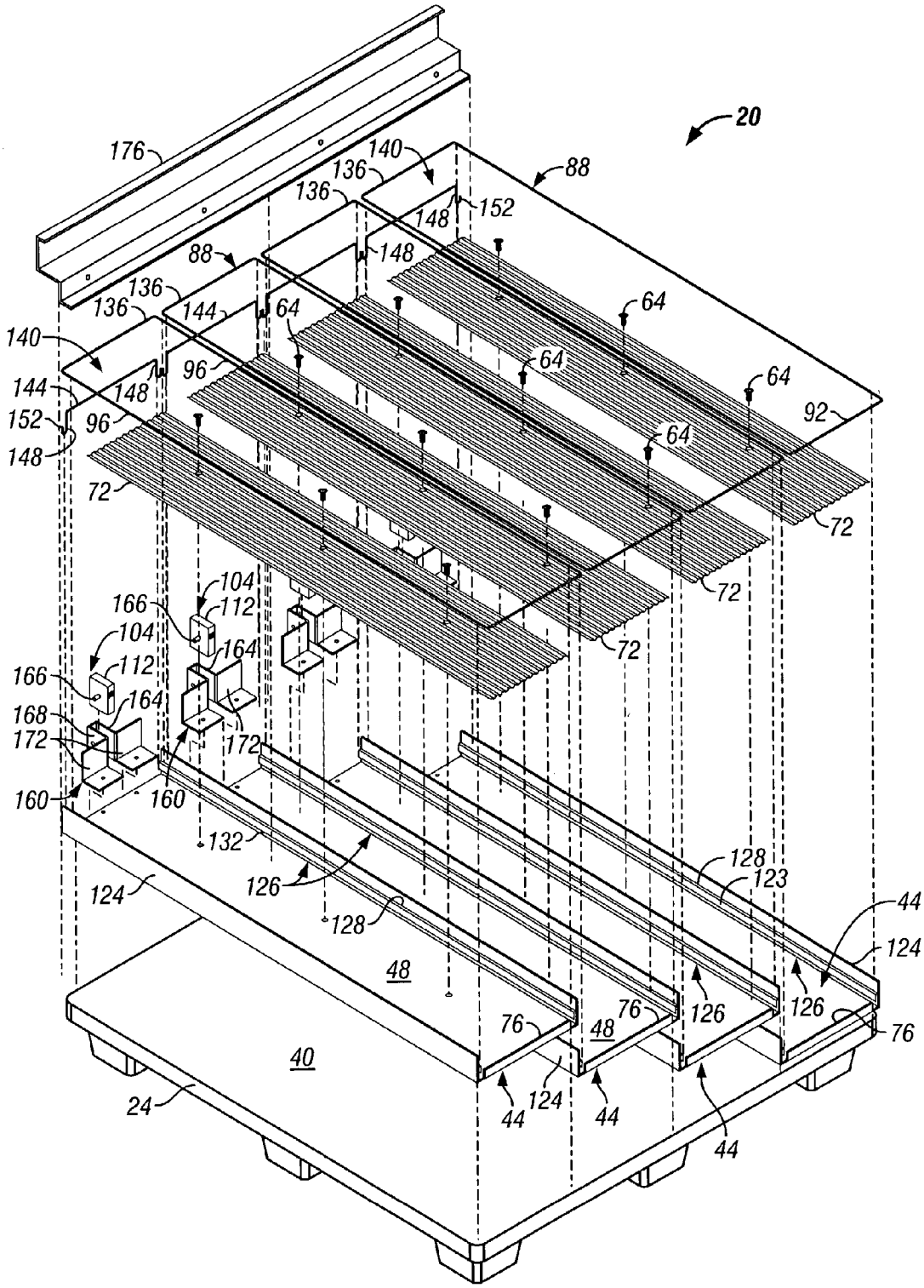
FIG. 8 is an exploded perspective view of the product fronting assembly shown in FIG. 7.
Figure 9:
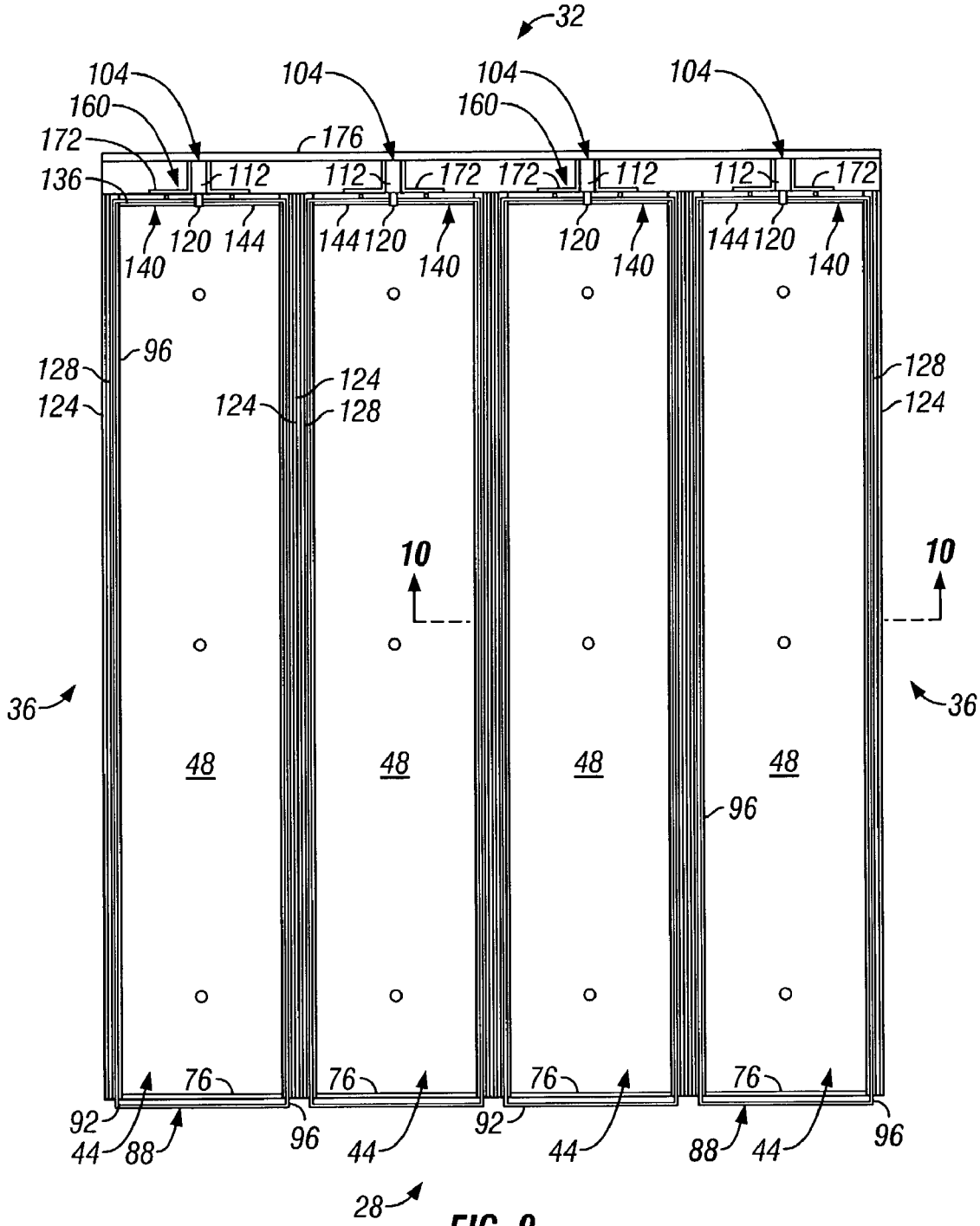
FIG. 9 is a top view of the product fronting assembly shown in FIGS. 7 and 8, shown with slides removed.

As shown in FIG. 6, in some embodiments the rear member 100 is normally located as far towards the rear 32 of pallet 24 as possible, thereby maximizing the amount of product 68 that can be stored in each divider 44. Similarly, the handle 92 can be located as far towards the front 28 of the pallet 24 as possible, thereby presenting the handle 92 in an easily accessible location (in some cases extending from beneath an overhead shelf). As shown best in FIGS. 1 and 3, the handle 92 can be positioned in front of the pallet 24, thereby providing an easily accessible location for a user. In other embodiments, the handle 92 can be positioned in any other location between the rear and the front of the divider to accommodate varying shapes and sizes of dividers 44 and to accommodate varying applications of the dividers 44. For example, it may be undesirable to have the handle 92 extend beyond the front of the pallet 24, in which case the handle 92 can be recessed behind the front of the divider 44. Recession of the handle 92 behind the front of the divider 44 can help prevent individuals from tripping over or bumping into the handle 92, and can help prevent shopping carts or powered vehicles (e.g., fork trucks, power carts, etc.) from hitting and damaging the handle 92.

In some embodiments of the present invention, the fronting mechanism 88 is spring-biased to return the fronting mechanism 88 to a desired position or orientation upon release by a user. An example of such a spring-biased fronting mechanism 88 is illustrated in FIGS. 1–4 and 6. In the illustrated embodiment, a spring mechanism 104 is secured to a rear support 108 and is connected to the fronting mechanism 88 to bias the fronting mechanism 88 toward its normal (retracted) position. The spring mechanism 104 includes a housing 112 and at least one return strap 120. In some embodiments, the at least one strap 120 is flexible and can be made of a number of different materials, such as, Mylar™, spring steel, and the like, and can be pinned, clamped, riveted, screwed, bolted, and the like to the housing 112. When extended from the housing 112, the return strap 120 exerts a biasing force to wind the extended portion of the return strap back 120 within the housing 112, such as about a spool, axle, pin, or other member about which the return strap 120 is wound. Accordingly, the strap 120 functions as a spring to bias the fronting mechanism 88 in a rearward direction in the divider 44.

In other embodiments, a cable, rope, wire, tape, or other elongated and flexible element can be wound about a spring-biased spool, axle, pin, or similar element. Accordingly, a spool, axle, pin, or other similar element can function to wind up (retract) the cable, rope, wire, tape, or other elongated and flexible element, thereby pulling the fronting mechanism 88 toward a retracted position. In such cases, the cable, rope, wire, tape, or other elongated and flexible element 120 can be fixed at one end within the housing 112 and at another end to the rear member 100. It should be noted that in some embodiments of the spring mechanism 104, the housing 112 is not employed. It should also be noted that other devices exist for retracting the fronting mechanism 88 toward a retracted position in the divider 44, each of which falls within the spirit and scope of the present invention.

As shown in FIG. 6, one fronting mechanism 88 in the assembly 20 is partially pulled out, while another fronting mechanism 88 is in a normal (retracted) position. To pull a spring-loaded fronting mechanism 88 toward an extended position, enough force must be applied to the handle 92 in a direction out from the front 28 of the pallet 24 to overcome the bias of the spring mechanism 104. When the bias of the spring mechanism 104 is overcome, the handle 92 moves forward and the rear member 100 engages the product 68 (unless the rear member 100 was previously engaged with the product 68) to move the product 68 toward the front 28 of the pallet 24. By releasing the handle 92, the bias of the spring mechanism 104 is no longer overcome, and the cable 120 retracts to bias the fronting mechanism 88 back toward the normal position.

Referring to FIGS. 7–11, another exemplary embodiment of the product display and fronting assembly 20 is illustrated. With some exceptions (described in greater detail below), the assembly 20 illustrated in FIGS. 7–11 is similar to the assembly 20 described above with reference to FIGS. 1–6. Accordingly, reference is made to the above discussion regarding the structure, operation, and alternatives of the assembly illustrated in FIGS. 7–11, wherein like elements and features of the assembly illustrated in FIGS. 7–11 have like reference numerals.

The assembly 20 illustrated in FIGS. 7–11 includes the pallet 24 having a front 28, rear 32, sides 36, and a top surface 40. Although a pallet-based assembly is shown, the present invention can be employed with any other product storage and/or display device or assembly as discussed above with reference to the embodiment of FIGS. 1–6. The top surface 40 is segregated by a plurality of dividers 44.

The dividers 44 in the illustrated embodiment of FIGS. 7–11 are mounted to the pallet 24 adjacent to one another in any suitable manner, such as the securing bolts 64 or any of the fastening manners described above with reference to the embodiments corresponding with FIGS. 1–6. In some embodiments of the present invention, the dividers 44 are not interconnected with each other and are solely mounted to the pallet 24 or any other product storage and/or display device or assembly. In other embodiments of the present invention, the dividers 44 are interconnected in any of the manners discussed above regarding the embodiment of FIGS. 1–6 and alternatives thereto. In further embodiments of the present invention, the dividers 44 illustrated in FIGS. 7–11 can be utilized without a pallet 24 or any other product storage and/or and act as shelves or racks themselves.

Each divider 44 in the illustrated embodiment of FIGS. 7–11 includes side walls 124, a base wall 48, and a front stop 76. Side walls 124 extend vertically upward from the base wall 48 and either or both side walls 124 include a support 126 (see FIGS. 8 and 10) extending therefrom upon which the fronting mechanism 88 is supported. The support 126 can take a number of different forms, including one or more fingers, bosses, tabs, pins, or other protrusions extending from the walls 124, a ledge defined in or otherwise extending from the side walls 124, or the like. In the illustrated embodiment of FIGS. 7–11, the support 126 is a ledge defined by a flange 128 (see FIG. 10) extending from the side wall 124. The flange 128 can be a separate element connected to the side wall 124 in any manner or can be integral with the wall 124 (e.g., a bent part of the side wall 124 or a portion of the side wall 124 that otherwise extends away from the side wall 124). The flange 128 (or other supports) can extend any length along the divider 44.

In these and other embodiments, either or both of the side walls 124 can have a longitudinal recess defined therein within which a portion of the fronting mechanism 88 can be received. The recess can extend along any part or all of the side wall 124 and can either be integral with the side wall 124 (e.g., a bent part of the side wall or a portion of the side wall that otherwise has a shape defining the recess) or can be defined by one or more elements connected to the side wall in any manner to define the recess. The recess can be oriented in any manner, such as, horizontally, vertically upward, vertically downward, angled upward, angled downward, and the like, to slidably receive a portion of the fronting mechanism 88. In the illustrated embodiment of FIGS. 7–11, the recess is defined by the side wall 124 and a flange 132 oriented to define a downwardly-opening channel (see FIG. 10). The flange 132 extends downwardly from the flange 128 and can be a separate element from the flange 128 or can be integral with the flange 128 to form part of the support 126.

In some embodiments such as the illustrated embodiment of FIGS. 7–11, one fronting mechanism 88 is used with each divider 44. The fronting mechanism 88 can take any of the forms described above with reference to the embodiment illustrated in FIGS. 1–6. In the embodiment of FIG. 7–11 for example, the fronting mechanism 88 includes handle 92, side members 96, a rear beam 136, and a rear member 140. In some embodiments, the handle 92, side members 96, and rear beam 136 are oriented in substantially the same plane as shown in FIGS. 7–11. Also, these portions of the fronting mechanism 88 can be separate elements connected in any of the manners described above or can be portions of a single integrally formed piece. The rear member 140 includes a horizontal cross beam 144, two vertically oriented portions 148 extending downwardly from the cross beam 144, and two upwardly-turned portions 152. Slots 156 are defined between the vertically oriented portions 148 and the upwardly-turned portions 152.

In the illustrated embodiment of FIGS. 7–11, the cross beam 144 has a width narrower than the distance between the side members 96 so that the cross beam 144 can be received between the side members 96 and can be mounted to the side members 96 and/or the rear beam 136. If the cross beam 144 is mounted to the rear beam 136, it can be mounted thereto either by inserting the cross beam 144 between the side members 96 and mounting the cross beam 144 to the front side of the rear beam 136 or by positioning the cross beam 144 against a back side of the rear beam 136 and mounting it thereto. The cross beam 144 can be mounted to the side members 96 and/or the rear beam 136 in any suitable manner, such as by welding, fasteners, or in any of the manners described above with regard to the assembly of multiple-part dividers 44. Alternatively, the fronting mechanism 88 can be a single component with the handle 92, side members 96, rear beam 136, and rear member 140 integrally formed.

Figure 10:
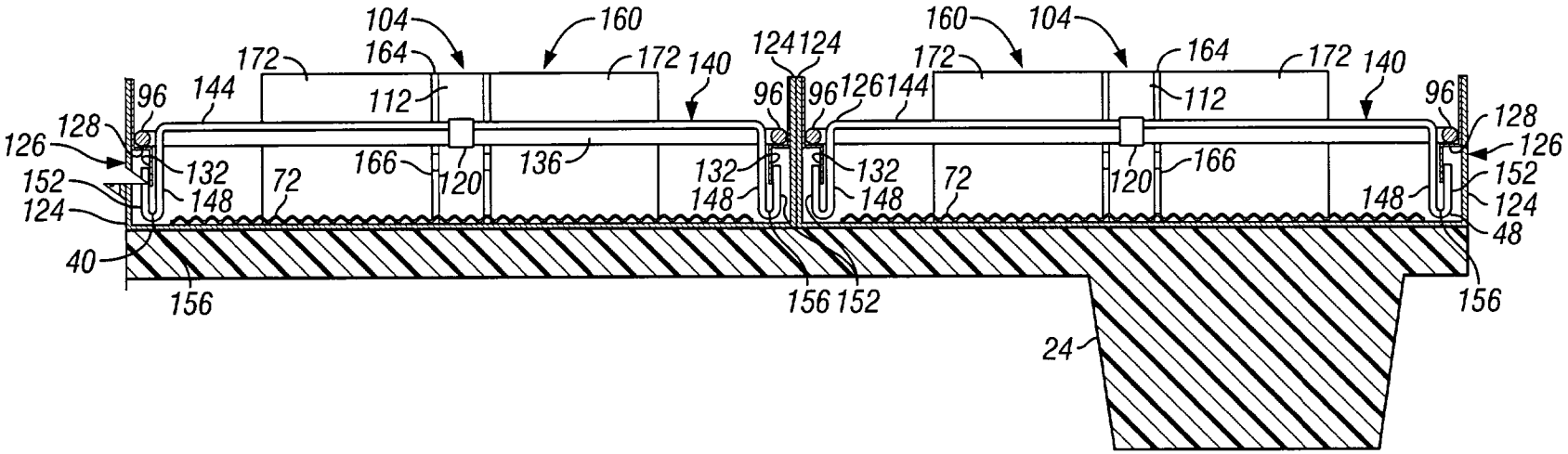
FIG. 10 is a cross-sectional view of the product fronting assembly illustrated in FIGS. 7–9, taken along line 10—10 in FIG. 9 and shown with a bumper plate removed.
Figure 11:
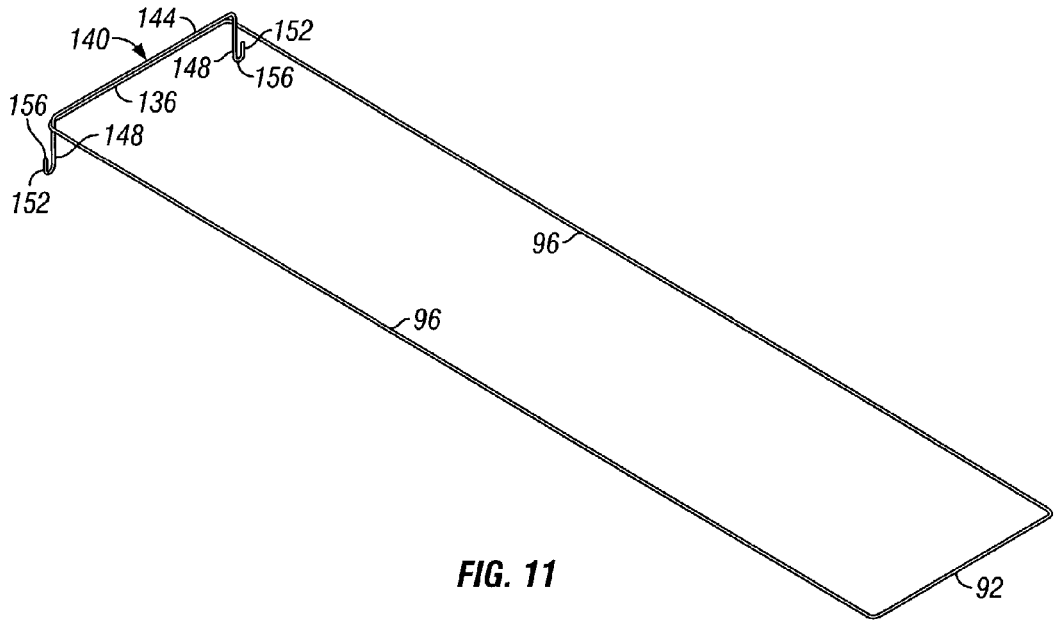
FIG. 11 is a front perspective view of a fronting device from the product fronting assembly shown in FIGS. 7–10.

With particular reference to FIG. 10, each side member 96 of the fronting mechanism 88 is supported upon one of the flanges 128 (or other types of supports 128 as described above). In addition, the upwardly-turned portions 152 in the illustrated embodiment of FIGS. 7–11 are received within the recesses defined between the side walls 124 and the flanges 132, while the flanges 132 are received within the slots 156 (see FIG. 10). Upon moving the fronting mechanism 88 between the extended and retracted positions, the side members 96 slide along the tops of the flanges 128 while the rear member 140 is guided along the divider 44 by the flanges 132.

Any portion of the fronting mechanism 88 can be received within the recesses located in or defined on the side walls 124 of the divider 44 (e.g., between the side walls 124 and the flanges 132 in the illustrated embodiment of FIGS. 7–11) to guide the fronting mechanism 88 within the divider 44. For example, each side 96 of the fronting mechanism 88 illustrated in FIGS. 7–11 can extend into a recess (such that each side 96 is positioned below flange 128 and between the flange 132 and the side wall 124). As another example, an element or elements attached to the fronting mechanism 88 (e.g., the rear member 140 as illustrated and described above) can extend into recesses in the divider walls 124, or pins, posts, or flanges can extend from the fronting mechanism 88 into divider wall recesses, and the like.

The assembly 20 illustrated in FIGS. 7–11 can employ spring mechanisms similar in construction, operation, and manner of attachment to those described above with reference to the embodiment of FIGS. 1–6 (and alternatives thereto). As another example of a manner in which to mount the spring mechanisms 104, the exemplary assembly 20 includes a plurality of spring brackets 160 to which the spring mechanisms 104 can be attached. The spring brackets 160 can be mounted to the rear 32 of the pallet 24 in any of the manners described above with reference to the connection of the spring mechanisms 104 to the dividers 44 in the embodiments corresponding to FIGS. 1–6. Alternatively, the spring brackets 160 can be mounted to the dividers 44 in any fastening manners discussed above with reference to assembly of multiple-part dividers 44.

Each spring bracket 160 can have a central opening, recess, or other receptacle 164 within which one spring mechanism 104 is insertable. A pin 166 or other fastener can be inserted into apertures 168 defined in the spring bracket 160 in order to secure the spring mechanism 104 to the spring bracket 160, although any other manner of connection can instead be employed as desired. The spring mechanism 104 can take any of the forms described above relating to the embodiments corresponding to FIGS. 1–6. In some embodiments, the spring bracket 160 has one or more back plates 172 or other stops that prevent products 68 from sliding or being pushed off the rear 32 of the pallet 24. Alternatively or in addition, the system 20 can include a bumper plate 176 connected to the rear 32 of the pallet 24 for performing this function and/or for shielding the rear 32 of the system 20.

Figure 12:
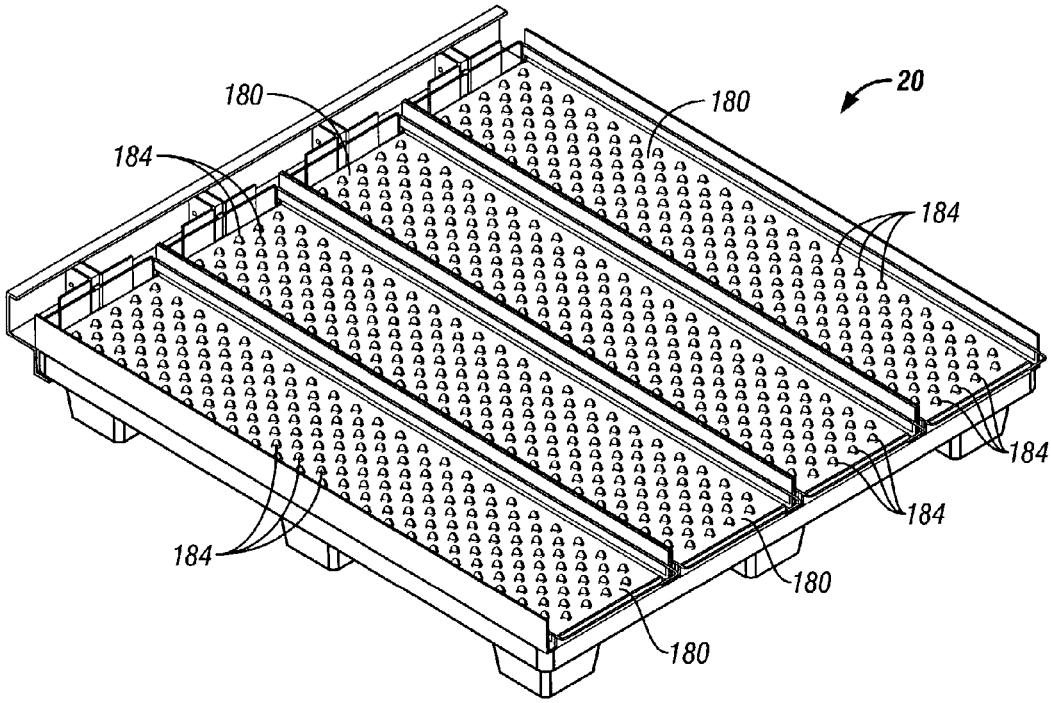
FIG. 12 is a top perspective view of a product fronting assembly according to another embodiment of the present invention.

It is desirable in many retail environments to reduce friction between products 68 and a surface upon which the products rest, are displayed, and are dispensed from. In the illustrated embodiment, products 68 rest upon the dividers 44 which can rest upon a product storage and/or display device or assembly, such as a pallet, a rack, shelving, and the like. With reference to FIG. 12, an example of a slide or sliding surface that can be employed in the present invention to reduce friction with the products 68 is illustrated. The sliding device in FIG. 12 includes at least one support sheet 180 and a plurality of ball rollers 184. In some embodiments, two or more support sheets 180 are spaced apart and include a plurality of apertures in which the plurality of ball rollers 184 are supported. In some embodiments, the plurality of ball rollers 184 are supported within the apertures in such a manner that they can rotate with very little resistance, thereby allowing products 68 stacked upon the ball rollers 184 to more easily slide along the dividers 44 with reduced resistance. The support sheets 180 can be any suitable material, but are preferably made from metal or plastic. One having ordinary skill in the art will appreciate that a number of different sheets employing ball bearings to reduce sliding resistance exist and can be employed as alternatives to the support sheets 180 illustrated in FIG. 12.

Figure 13:
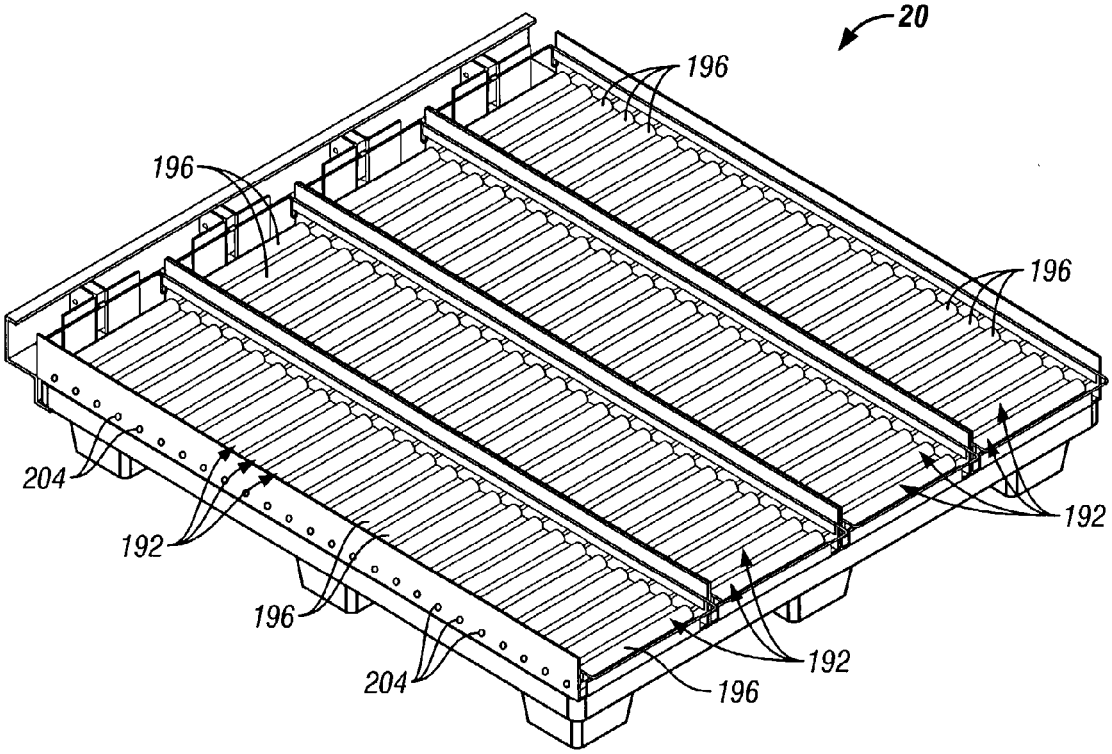
FIG. 13 is a top perspective view of a product fronting assembly according to another embodiment of the present invention.

Referring to FIG. 13, another example of a sliding surface that can be employed in the present invention to reduce friction with the products 68 is illustrated. In this embodiment, the sliding device 72 includes a plurality of rollers 192, each roller having a cylindrical shaft, cylinder, or drum 196 upon which product can be rolled. The rollers 192 can rotate about a stationary shaft that is secured against rotation at either or both ends (e.g., by being inserted into apertures 204 in the side walls of the dividers 44 and being secured against rotation in any conventional manner or by having a shape resistant to rotation in the apertures), or can be secured to a rotating shaft or axle mounted in conventional bearings. The rollers 192 can be made of any suitable material to withstand the load of products 68 supported thereon, and in some embodiments comprise plastic or metal.

There has been described, with reference to specific exemplary embodiments thereof, a product display and fronting system. It will be apparent to those skilled in the art that modifications may be made without departing from the spirit and scope of the invention. All modifications are considered within the spirit and scope of the present invention. The specification and drawings, therefore, are to be regarded in an illustrative rather than restrictive sense.

The invention claimed is:

1. A product fronting assembly for fronting product, the product fronting assembly comprising:

a base having a bottom;

a front;

a rear; and upstanding opposite sides; and a frame slidable within the base between the upstanding opposite sides of the base, the frame having a front at least partially defining a handle;

opposed sides coupled to the front of the frame and between which product upon the base is received, the opposed sides positioned to rest and slide upon at least one of the bottom and the upstanding opposite sides of the base; and a rear coupled to the opposed sides wherein the frame is movable through a path in which the frame pushes product located between the opposed sides of the frame toward the front of the base.

2. The product fronting assembly as claimed in claim 1, wherein one of the upstanding opposite sides of the base includes a flange releasably engagable with a side of an adjacent product fronting assembly.

3. The product fronting assembly as claimed in claim 1, wherein the front of the base includes a front stop extending into a product path extending through the assembly.

4. The product fronting assembly as claimed in claim 1, further comprising a slide positioned on the bottom of the base and upon which product is slidable.

5. The product fronting assembly as claimed in claim 4, wherein the slide has a corrugated shape.

6. The product fronting assembly as claimed in claim 1, further comprising a spring coupled to the base and the frame to bias the frame toward the rear of the base.

7. The product fronting assembly as claimed in claim 1, further comprising:

a bracket coupled to the rear of the base, the bracket having a receptacle; and a spring coupled to the bracket and at least partially received within the receptacle, the spring positioned to bias the frame toward the rear of the base.

8. The product fronting assembly as claimed in 1, wherein at least one of the upstanding opposite sides of the base includes a support upon which the frame is at least partially supported, the support including a flange upon and along which one of the opposed sides of the frame is supported and is slidable.

9. The product fronting assembly as claimed in claim 1, wherein at least one of the upstanding opposite sides of the base has a recess within which a portion of the frame is received, the portion of the frame being slidable within and along the recess in movement of the frame within the base.

10. The product fronting assembly as claimed in claim 1, wherein the rear of the frame is at a higher elevation than the sides of the frame.

11. The product fronting assembly as claimed in claim 1, wherein the bottom, front, rear, and upstanding opposite sides of the base are a single integral unit.

12. The product fronting assembly as claimed in claim 1, wherein the frame is a loop extending about at least a portion of the base and within which product is received.

13. A product fronting assembly for fronting product, the product fronting assembly comprising:

a base having a bottom wall, and opposed side walls extending from the bottom wall; and a frame slidably positioned within the base and at least partially extending about product supported by the base, the frame having a handle;

a stop movable by movement of the handle, the stop positioned to engage product supported by the base by movement of the frame within the base; and opposed sides coupling the handle and the stop, the opposed sides being spaced a distance from one another, wherein a portion of the frame extends within and is slidable within a recess in each side wall of the base.

14. The product fronting assembly as claimed in claim 13, further comprising a slide on the bottom wall and upon which product is slidable along the product fronting assembly.

15. The product fronting assembly as claimed in claim 14, wherein the slide is corrugated in shape.

16. The product fronting assembly as claimed in claim 13, further comprising a spring coupled to the base and to the frame, the spring positioned to bias the frame toward a rear of the base.

17. The product fronting assembly as claimed in 13, wherein the sides of the frame are at least partially supported and are slidable upon the sides of the base.

18. The product fronting assembly as claimed in claim 13, wherein the stop of the frame extends to a position behind product in the assembly, at least part of the stop being located at a higher elevation than the sides of the frame.

19. A method of fronting product, comprising:

placing product upon a base having a bottom, front, rear, and opposite sides;

sliding a frame upon the base in a direction toward the front of the base;

sliding sides of the frame upon at least one of the sides and bottom of the base while sliding the frame upon the base;

providing a rear of the frame extending between and coupling the sides of the frame;

pushing the rear of the frame against the product upon the base, the product being located between the sides of the frame; and moving the product upon the base toward the front of the base by pushing the rear of the frame against the product upon the base.

20. The method as claimed in claim 19, further comprising biasing the frame toward a rear of the base via a spring coupled to the frame.

21. The method as claimed in claim 19, further comprising retracting the frame toward the rear of the base by biasing force from the spring.

* * * * *